United States Patent [19]

Bothner

[11] Patent Number: 4,575,217

[45] Date of Patent: Mar. 11, 1986

[54] APPARATUS FOR SELECTIVELY SEALING A DISCRETE DIELECTRIC SHEET DEVELOPER STATION

[75] Inventor: Carl R. Bothner, Rochester, N.Y.

[73] Assignee: Eastman Kodak Company, Rochester, N.Y.

[21] Appl. No.: 678,196

[22] Filed: Dec. 4, 1984

[51] Int. Cl.[4] ..... G03G 15/00; G03G 15/08

[52] U.S. Cl. ..... 355/3 DD; 355/3 SH; 355/15; 355/3 R

[58] Field of Search ..... 355/3 DD, 14 D, 3 BE, 355/16, 4, 3 SH, 14 SH, 15, 3 R; 271/243, 246, 3, 226; 118/657

[56] References Cited

U.S. PATENT DOCUMENTS

| | | | |
|---|---|---|---|
| 3,145,122 | 8/1964 | Streich | 118/657 |
| 3,510,903 | 5/1970 | Stoever et al. | 15/256.5 |
| 3,536,400 | 10/1970 | Griffin, Jr. | 355/15 |
| 3,598,488 | 8/1971 | DiFrancesco et al. | 355/15 |
| 3,664,857 | 5/1972 | Miller | 118/656 X |
| 3,792,925 | 2/1974 | Milligan et al. | 355/15 |
| 3,809,012 | 5/1974 | Delvecchio | 118/657 X |
| 3,814,515 | 6/1974 | Takahashi et al. | 355/3 DD |
| 3,838,472 | 10/1974 | Oriel | 355/15 X |
| 3,845,951 | 11/1974 | Hamaker | 271/243 |
| 3,906,899 | 9/1975 | Harpavat | 118/647 X |
| 3,999,514 | 12/1976 | Abbott et al. | 118/657 |
| 4,014,608 | 3/1977 | Terashima | 355/4 |
| 4,040,386 | 8/1977 | Smith | 118/653 |
| 4,096,826 | 6/1978 | Stange | 118/656 |
| 4,110,035 | 8/1978 | Kamata | 355/15 |
| 4,120,577 | 10/1978 | Watanabe et al. | 355/4 |
| 4,127,083 | 11/1978 | Sesoko | 118/653 |
| 4,168,901 | 9/1979 | Ito et al. | 355/3 DD |
| 4,400,082 | 8/1983 | Kiba | 355/15 |

OTHER PUBLICATIONS

*Research Disclosure,* No. 13747, "Scavenger Bar for Back of Film", Sep. 1975, (Anonymous).

Kayson, "Developer Diverting Means", *Research Disclosure* No. 14648, Jun., 1976.

Cuomo et al., "Back Side Film Cleaning Apparatus", *Research Disclosure,* No. 18185, May, 1979.

*Primary Examiner*—A. C. Prescott

*Attorney, Agent, or Firm*—Lawrence P. Kessler

[57] ABSTRACT

In an electrographic copier wherein discrete dielectric sheets are moved seriatim about a travel path having a portion in juxtaposition with a developer station for developing imagewise electrostatic charge patterns on such sheets with developer material, apparatus for selectively sealing developer material within such station and, during such sealing, guiding a moving sheet along such travel path portion out of developing relation with such developer material. The apparatus comprises a member selectively movable to a first position sealing developer material within the developer station and forming a sheet guide coincident with the sheet travel path portion, or a second position remote from such first position. In response to the lead edge of a discrete dielectric sheet moving away from the travel path portion, the member is moved to its second position leaving the sheet in developing relation to developer material in the developer station; and in response to the trail edge of such sheet moving into the travel path portion, the member is moved to its first position to seal developer material within such station and to guide such sheet along such travel path portion out of developing relation to developer material.

12 Claims, 7 Drawing Figures

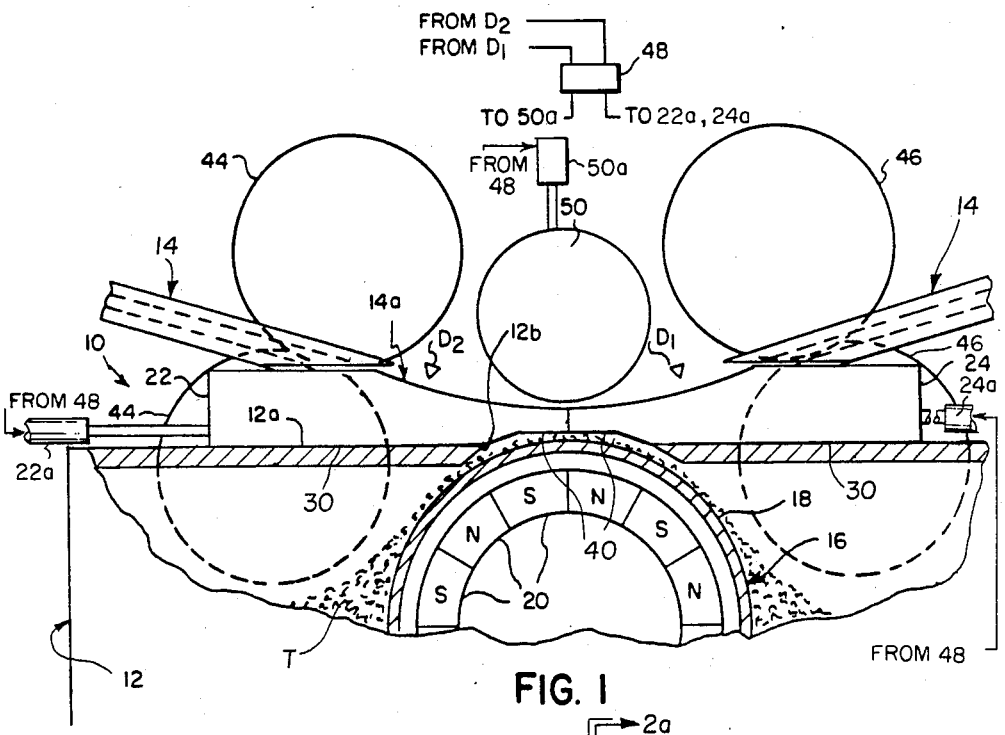
FIG. 1
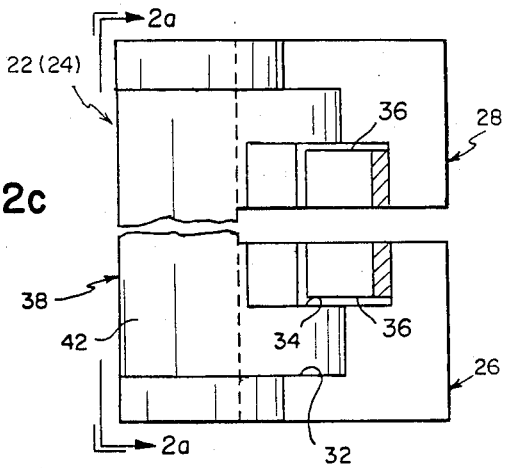
FIG. 2c
FIG. 2a
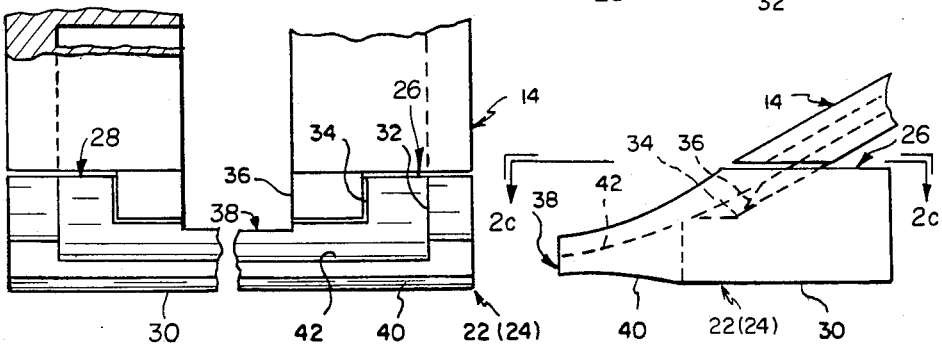
FIG. 2b

FIG. 3
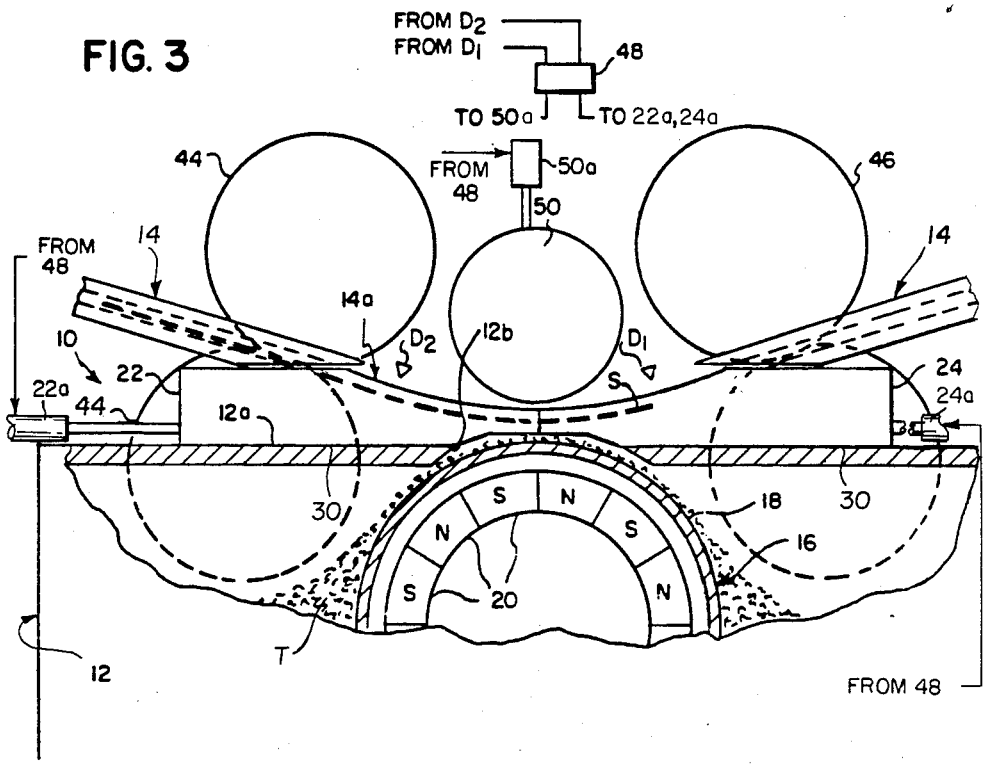
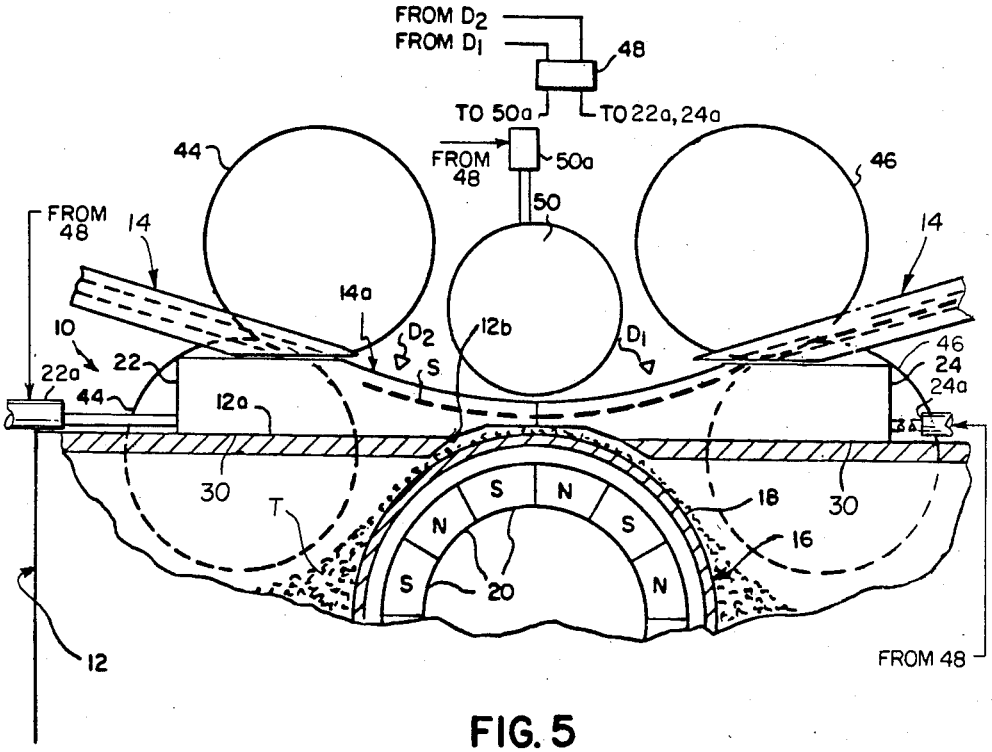
FIG. 5

APPARATUS FOR SELECTIVELY SEALING A DISCRETE DIELECTRIC SHEET DEVELOPER STATION

BACKGROUND OF THE INVENTION

This invention relates generally to apparatus associated with a station for developing electrostatic charge patterns on discrete dielectric sheets with developer material and, more particularly, to apparatus for selectively sealing developer material within a developer station and. during sealing, guiding moving discrete dielectric sheet out of developing relation with such developer material.

In U.S. Pat. No. 4,436,405 issued Mar. 13, 1984 in the name of Kindt, an electrographic copier is described which utilizes a plurality of discrete dielectric sheets respectively including a photoconductive layer. The discrete sheets are transported seriatim about a continuous path into operative relation with electrographic process stations to make information reproductions. In the reproduction process carried out at such process stations of the copier, a discrete dielectric sheet is uniformly charged and then exposed to an image of information to be reproduced (e.g., a document) to form an electrostatic charge pattern on such sheet corresponding image-wise to such information. The charge pattern is developed with pigmented thermoplastic electroscopic marking particles electrostatically attracted to the charge pattern to form a transferable image. The transferable image is then transferred from the sheet to a receiver member to form the information reproduction, and the sheet is cleaned for reuse.

The development of the charge patterns on the discrete dielectric sheets is accomplished by a magnetic brush developer station. In a typical magnetic brush developer station, developer material including pigmented electroscopic marking particles adhering to magnetizable particles (or single component material where the pigmented particles are in themselves magnetizable) are brought into a magnetic field intercepting the path of a moving electrostatic charge pattern carrying member. The magnetizable particles align in the magnetic field to form a brush-like bristle nap of pigmented particles which contact such member. The pigmented particles are electrostatically attracted from the nap to the charge pattern and adhere to such pattern for development. However, when the charge pattern carrying member is a discrete sheet, there is a propensity for the leading edge of such sheet to plow through the bristle nap. This can lead to deposition of developer material on the back side of the sheet. Therefore, cleaning of the sheet is made more complex (i.e., the back side as well as the front side must also be cleaned). Moreover, contamination within the copier environment by airborne developer material, or non-transferred developer material carried out of the magnetic brush developer station by the sheet, is potentially increased.

In the commonly assigned copending U.S. patent application Ser. No. 633,564, filed July 23, 1984, in the name of Crandall, a mechanism is disclosed which prevents a moving discrete dielectric sheet from plowing through a bristle nap of a magnetic brush developer station. Such mechanism includes a movable belt in contact with the developer station and overlying the bristle nap to seal developer material of such nap within the developer station. The belt has an opening substantially congruent with the image (charge pattern bearing) area of a discrete dielectric sheet. The belt and sheet are moved in timed relation so that the image area of the sheet overlies the belt opening as a sheet is moved into developing relation with the nap. Thus, the marginal edges of the sheet are shielded by the belt and the image area is located so as to be developed by material from the nap. While this mechanism is successful in preventing the sheet from plowing through the magnet brush bristle nap, it requires accurate interrelated control of movement of the shielding belt with the sheet to ensure the alignment of the belt opening and the sheet image area during development.

SUMMARY OF THE INVENTION

This invention is directed to apparatus, in an electrographic copier wherein discrete dielectric sheets are moved seriatim about a travel path having a portion in juxtaposition with a developer station for developing imagewise electrostatic charge patterns on such discrete sheets with developer material, for selectively sealing developer material within such station and, during such sealing, guiding a moving sheet along such travel path portion out of developing relation with such developer material. The apparatus comprises a member selectively movable to a first position sealing developer material within the developer station and forming a sheet guide coincident with the sheet travel path portion, or a second position remote from such first position. In response to the lead edge of a discrete dielectric sheet moving away from the travel path portion, the member is moved to its second position leaving the sheet in developing relation to developer material in the developer station; and in response to the trail edge of such sheet moving into the travel path portion, the member is moved to its first position to seal developer material within such station and to guide such sheet along such travel path portion out of developing relation to developer material.

The invention, and its objects and advantages, will become more apparent in the detailed description of the preferred embodiment presented below.

BRIEF DESCRIPTION OF DRAWING

In the detailed description of the preferred embodiment of the invention presented below, reference is made to the accompanying drawings, in which:

FIG. 1 is a side elevational view, partly in cross-section of a magnetic brush developer station including the sealing and discrete dielectric sheet guiding apparatus according to this invention, FIGS. 2*a*, 2*b* and 2*c* are end, side and top elevational views respectively of one of the movable portions of the sealing and guiding apparatus of FIG. 1; and FIGS. 3, 4 and 5 are side elevational views, similar to FIG. 1, taken at different times in the operation of the sealing and guiding apparatus according to this invention.

DESCRIPTION OF PREFERRED EMBODIMENT

Figure 4:
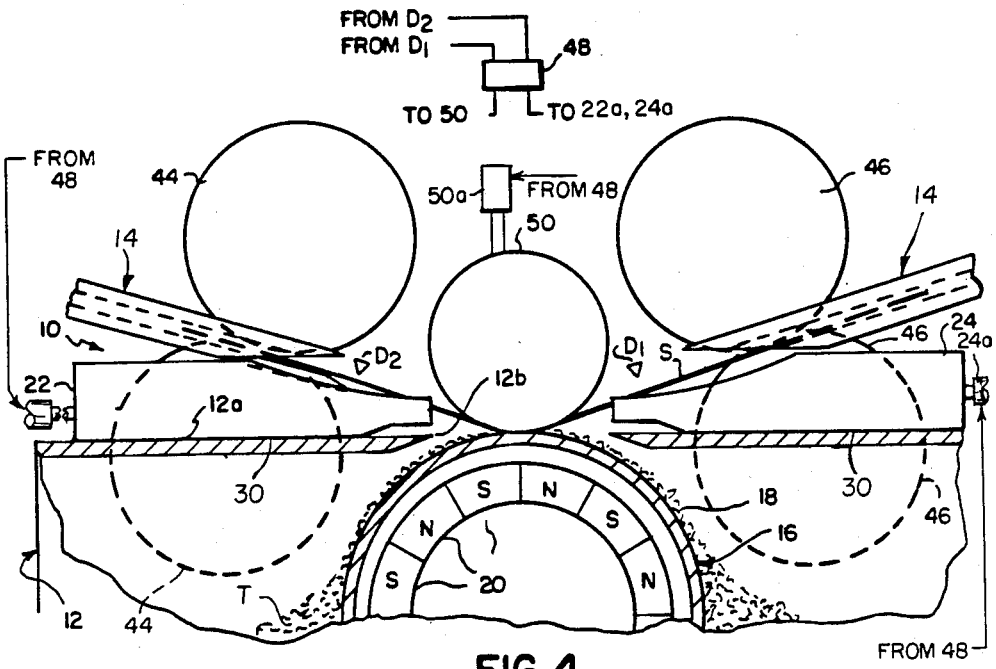

Referring now to the accompanying drawings, a magnetic brush developer station, designated generally by the numeral 10, is shown in FIG. 1. The developer station 10 includes a housing 12 forming a reservoir for particulate developer material T. The developer material T comprises, for example, a mixture of finely divided pigmented thermoplastic electroscopic marking particles (toner) held to the surface of ferromagnetic particles (carrier) by electrostatic charges created by triboelectrification. Of course, developer material of the type comprised solely of marking particles which exhibit magnetic properties (referred to as single component developer) is also suitable for use with this invention.

The housing 12 of developer station 10 includes a top wall 12*a* having an opening 12*b*. The opening 12*b* is located in juxtaposition with a guide track assembly 14 of an electrographic copier utilizing moving discrete dielectric sheets, such as for example the aforementioned U.S. Pat. No. 4,436,405. The guide track assembly of the copier of such patent supports marginal edges of discrete dielectric sheets and describes a path about which such sheets are transported seriatim and guided into operative relation with electrographic process stations. Of course, other guide assemblies for discrete dielectric sheets are suitable for use with this invention. The discrete dielectric sheets, which respectively include a photoconductive layer and an insulating layer, are uniformly charged and then exposed over an image-receiving area to a light image of information to be reproduced. Such exposure selectively alters the uniform charge to form electrostatic charge patterns on the sheets respectively corresponding image-wise to the light image. The charge patterns are developed by electroscopic marking particles to form transferable images on the sheets, and such images are then transferred from the sheets to receiver members to form the information reproductions. Of course, the developer station 10 is suitable for use in other discrete dielectric sheet copier apparatus, such as where the developed images are fixed directly on the sheet for example.

An applicator 16, mounted in the housing 12 of the developer station 10, is adapted to transport developer material through the opening 12*b* into the discrete dielectric sheet travel path. The applicator 16 includes a rotatable hollow cylindrical shell 18 of non-magnetic material such as aluminum. The shell 18 is oriented such that its longitudinal axis spans the width of the guide track assembly and lies in a plane parallel to the plane of sheet travel through such assembly. A series of magnets 20 are supported within the shell. The particles of the developer material align in the fields of the magnets to establish a brush-like bristle nap extending substantially radially from the shell. As the shell rotates the bristles are moved through the opening 12*b* in the top wall 12*a* of the developer station housing and extend into the travel path of a discrete dielectric sheet. For a more detailed description of a typical magnetic brush developer station, see for example U.S. Pat. No. 3,457,900, issued July 29, 1969, in the name of Drexler et al. Of course, other magnetic brush developer stations (e.g., with plural applicators, or having a stationary shell with rotating magnets) establishing a path-intercepting developer material bristle nap are suitable for use with this invention.

In order to prevent developer material T from escaping from the developer station 10 and discrete dielectric sheets from plowing through the developer material bristle nap as the sheets approach the station 10, apparatus 14*a* is provided to selectively seal developer material within the station and, during such sealing, guide a sheet along its travel path out of developing relation with such material. The apparatus 14*a* is configured as a pair of movable shoe members 22, 24. Since the shoes are mirror images of one another, only one is shown in detail in FIGS. 2*a*, 2*b*, 2*c*. The shoes include portions 26, 28 interconnected by portion 38 and spaced to be respectively coincident with marginal edge supporting portions of the guide track assembly 14. The portions 26, 28 have a bottom surface 30 slidably received for reciprocation on the top wall 12*a* of the developer station housing 12. The top surfaces of portions 26, 28 have a first notch 32 forming an extension of guide track asembly 14 and a second notch 34 for receiving an extended tip 36 of the guide track assembly. The portion 38 has a bottom surface 40 adapted to seal the developer station opening 12*b* and an upper surface 42 adapted to guide a discrete dielectric sheet.

In operation, the shoe members 22, 24 are initially in a first position in an end-to-end relationship (see FIG. 1). As such, the surfaces 40 of the abutting portions 38 form a contiguous seal covering the opening 12*b* of the developer station housing top 12*a*, and surfaces 42 form a sheet guide coincident with the portion of the sheet travel path adjacent to the developer station. Thus, developer material is substantially contained within the developer station housing 12 and prevented from contaminating the interior of the copier. During the reproduction process, a discrete dielectric sheet (e.g. sheet designated by letter "S" in FIGS. 3, 4, 5), bearing an image-wise electrostatic charge pattern to be developed is transported through the upstream portion of the guide track assembly 14 toward the developer station 10 by driven nip roller pair 44. With the shoe members 22, 24 in the position of FIG. 1, extensions 36 of the guide track fit in notches 34 respectively. Therefore, the transported sheet is directed without interference into apparatus 14*a* and guided on the lower surfaces of notches 32, 34 and surface 42 of portion 38 to the downstream portion of the guide track assembly 14 (see FIG. 3) and into the driven nip roller pair 46. During such travel, such sheet is out of developing relation with the developer material.

A detector $D_1$, such as a photoelectric cell or mechanical switch for example, is located immediately upstream of the nip roller pair 46. Detector $D_1$ senses the arrival of the lead edge of the charge pattern bearing sheet and, in response to such arrival, produces an appropriate control signal. Such control signal is used, at a predetermined time sufficient to enable such lead edge to enter the control of nip roller pair 46, to actuate an appropriate mechanism 48 as the lead edge exits the apparatus 14*a*. The mechanism 48 slides the shoe members 22, 24 apart to their positions shown in FIG. 4 (i.e., a second position remote from the opening 12*b*) leaving the sheet in developing relation with the developer material extending into opening 12*b* from applicator 16.

A compliant back-up roller 50 is located adjacent to the applicator 16 on the opposite side of the sheet travel path. The longitudinal axis of the roller 50 extends substantially across the developer station and is parallel to the longitudinal axis of the applicator 16. The mechanism 48, on actuation, also moves the roller 50 to a position shown in FIG. 4 where the entire sheet is urged, element-by-element, through such developing relation to assure uniform development of the electrostatic charge pattern on such sheet. The surface of the roller 50 may be formed of a low friction material such as rayon for example. Such surface is in non-rolling contact with the moving discrete dielectric sheet to wipe the back surface of the sheet and clean such back surface. It should be noted that the distance between the point of tangency of the sheet with roller 50 and the nip of roller pair 46 is less than the distance between the lead edge of a sheet and the adjacent marginal edge of its charge pattern bearing area. Thus, when the shoes are moved to their remote positions, the charge pattern bearing area of the sheet from such marginal edge will be in developing relation with the developer material for complete image development.

As the trail edge of the sheet bearing the charge pattern being developed exits the control of nip roller pair 44, a detector $D_2$ (similar to detector $D_1$) senses such trail edge and produces an appropriate control signal. Such control signal, at a predetermined time, is used to actuate the mechanism 48 to move the back-up roller 50 to its remote position as shown in FIG. 5 and substantially simultaneously slide the shoe members 22, 24 together into their first position. Accordingly, the developer station 12 is resealed and remains resealed while the trail edge of the sheet is guided by the shoes to pass over the developer station 10 out of developing relation with developer material. Similarly to the arrangement described above, the distance between the point of tangency of the sheet with the roller 50 and the nip of roller pair 44 is less than the distance between the trail edge of the sheet and the adjacent marginal edge of its charge pattern bearing area. Thus, development of the entire image area occurs before the shoes return to their first position. With the shoes in their first position, they are, of course, then ready for guiding the next discrete dielectric sheet directed along guide track assembly 14 toward developing relation with the station.

The invention has been described in detail with particular reference to a preferred embodiment thereof, but it will be understood that variations and modifications can be effected within the spirit and scope of the invention.

I claim:

1. In an electrographic copier including a developer station containing developer material and having means for developing, with such developer material, imagewise patterns on discrete dielectric sheets, and means for moving such sheets seriatim about a travel path having a portion in juxtaposition with such developer station, apparatus for selectively sealing developer material within such developer station and, during such sealing, guiding a moving discrete dielectric sheet along such travel path portion out of developing relation with such developer material, said apparatus comprising:

at least one member having a developer material sealing surface and a discrete dielectric sheet guiding surface;

means for selectively moving said member to a first position between said developer station and such travel path portion, wherein said sealing surface seals developer material within said developer station and said guiding surface is coincident with such travel path portion, or to a second position remote from said first position, and means, responsive to the lead edge of a discrete dielectric sheet moving away from such travel path portion, for actuating said selective moving means to move said member to its second position leaving such moving sheet in developing relation to developer material in such developer station and, responsive to the trail edge of such sheet moving into such travel path portion, for actuating said selective moving means to move said member to its first position to seal developer material within said developer station and to guide such sheet along such travel path portion out of developing relation to developer material.

2. The invention of claim 1 wherein said apparatus includes a pair of members respectively having a developer material sealing surface and a sheet guide surface, said members being movable into opposing relationship wherein said sealing surfaces and said sheet guide surfaces are respectively contiguous.

3. The invention of claim 1 wherein said apparatus further includes means, responsive to actuation of said selective moving means for moving said member to said second position, for urging a moving discrete dielectric sheet in such travel path portion relative to said path through developing relation with such developer material.

4. The invention of claim 3 wherein said discrete dielectric sheet urging means is located adjacent to said developer station on the opposite side of such sheet travel path portion from said developer station.

5. The invention of claim 4 wherein said discrete dielectric sheet urging means includes a low friction surface adapted to engage a surface of a moving sheet when said urging means is moved to its urging position and move relative to such sheet surface, whereby said low friction surface wipes such sheet surface to clean such surface.

6. In an electrographic copier including a magnetic brush developer station containing particulate developer material and having an applicator for developing, with such developer material, imagewise electrostatic charge patterns carried respectively on the surfaces of discrete dielectric sheets movable seriatim about a travel path having a portion in juxtaposition with such applicator, apparatus for selectively sealing developer material within such developer station and, during such sealing, guiding a moving discrete dielectric sheet along such travel path portion out of developing relation with said applicator, said apparatus comprising:

a pair of members, located between said developer station and such discrete dielectric sheet travel path, said members respectively including a sheet guiding surface and a developer material sealing surface;

means for selectively moving said pair of members to a first position in abutting relation adjacent to said applicator and between said applicator and such travel path portion, or to a second position where said members are separated and remote from said applicator and said travel path portion, whereby in said first position said guiding surfaces guide a discrete dielectric sheet moving along such travel path portion relative to said applicator out of developing relation therewith and said sealing surfaces seal particulate developer material within said developer station, and whereby in said second position said sealing surfaces are remotely located relative to said applicator to enable particulate developer material to be brought by said applicator into developing relation with such moving sheet to develop the electrostatic charge pattern carried by such sheet;

a member, located adjacent to said applicator and on the opposite side of such travel path portion therefrom, for cleaning the non-charge pattern carrying surface of such discrete dielectric sheets; and means for selectively moving said cleaning member to a first inoperative position remote from such travel path, or to a second position in juxtaposition with such travel path, whereby in said first position said cleaning member does not contact such moving discrete dielectric sheet so as not to interfere with sheet movement, and in said second position said cleaning member contacts and cleans such sheet.

7. The invention of claim 6 further including means, responsive to the lead edge of a discrete dielectric sheet moving away from such travel path portion, for activating said moving means for said pair of members to move said pair of members to their second position and, responsive to the trail edge of such sheet moving into such travel path portion, for actuating said moving means for said pair of members to move said pair of members to their first position.

8. The invention of claim 7 wherein when said moving means for said pair of members moves such members to their first position, said cleaning member moving means moves said cleaning member to its first position, and when said moving means for said pair of members moves such members to their second position, said cleaning member moving means moves said cleaning member to its second position.

9. The invention of claim 6 wherein said cleaning member is a roller having a peripheral surface coated with a low friction material adapted to engage the non-charge pattern carrying surface of discrete dielectric sheets when said roller is in said second position and move relative to such sheet surface, whereby said low friction material wipes such sheet surface to clean such surface.

10. In an electrographic copier including a developer station having a housing containing particulate developer material, an opening defined in such housing, and an applicator for developing imagewise electrostatic charge patterns carried respectively on the surfaces of discrete dielectric sheets with such developer material, such sheets being movable seriatim about a travel path having a portion in juxtaposition with such applicator, apparatus for selectively sealing developer material within such developer station and, during such sealing, guiding a moving discrete dielectric sheet along such travel path portion out of developing relation with said applicator, said apparatus comprising:

a pair of members, located between said developer station and such discrete dielectric sheet travel path, said members respectively including a sheet guiding surface and a developer material sealing surface; and means for selectively moving said pair of members to a first position in abutting relation coextensive with the opening of said developer station opening, or to a second position where said members are separated and remote from said opening, whereby in said first position said guiding surfaces guide a discrete dielectric sheet moving along such travel path portion relative to said applicator out of developing relation therewith and said sealing surfaces seal said opening and retain particulate developer material within said developer station, and whereby in said second position said sealing surfaces are remotely located relative said opening to enable said applicator to bring particulate developer material through said opening into developing relation with such moving sheet to develop the electrostatic charge pattern carried by such sheet.

11. The invention of claim 10 further including means, responsive to the lead edge of a discrete dielectric sheet moving away from such travel path portion, for activating said moving means to move said pair of members to their second position remote from said developer station opening and, responsive to the trail edge of such sheet moving into such travel path portion, for actuating said moving means to move said pair of members to their first position coextensive with said opening.

12. The invention of claim 11 further including means, located adjacent to said developer station opening on the opposite side of such sheet travel path portion from said developer station and responsive to actuation of said selective moving means for moving said pair of members to said second position, for urging a moving discrete dielectric sheet in such travel path portion relative to said path through developing relation with such particulate developer material.

* * * * *